United States Patent [19]

Bilstad et al.

[11] Patent Number: 4,630,448

[45] Date of Patent: Dec. 23, 1986

[54] CONTAINER FOR STORING SOLID LIVING TISSUE PORTIONS

[75] Inventors: Arnold C. Bilstad, Deerfield; William C. Brown, Palatine, both of Ill.

[73] Assignee: Baxter Travenol Laboratories, Inc., Deerfield, Ill.

[21] Appl. No.: 791,181

[22] Filed: Oct. 25, 1985

[51] Int. Cl.[4] ..... B65B 63/08

[52] U.S. Cl. ..... 62/60; 62/64; 435/2

[58] Field of Search ..... 62/60, 64; 435/2

[56] References Cited

U.S. PATENT DOCUMENTS

| | | | |
|---|---|---|---|
| 2,662,520 | 12/1953 | McMahon | 62/64 |
| 3,576,650 | 4/1971 | Underwood et al. | 62/60 |
| 3,875,754 | 4/1975 | Faust et al. | 62/60 |
| 3,905,477 | 9/1975 | Graham | 206/459 |
| 4,112,989 | 9/1978 | Grode et al. | 425/35 |
| 4,194,369 | 3/1980 | Faust et al. | 62/60 |
| 4,251,995 | 2/1981 | Pert et al. | 62/60 |
| 4,465,487 | 8/1984 | Nakamura et al. | 604/408 |
| 4,469,227 | 9/1984 | Faust | 62/60 |
| 4,474,016 | 10/1984 | Winchell | 62/60 |
| 4,482,585 | 11/1984 | Ohodaira et al. | 428/35 |

*Primary Examiner*—Ronald C. Capossela

*Attorney, Agent, or Firm*—Paul C. Flattery; Garrettson Ellis; Bradford R. L. Price

[57] ABSTRACT

A wide-mouthed flexible, collapsible, sterile bag made of sheeting of poly (ethylene-vinyl acetate) containing from 5 to 35 weight percent of vinyl acetate units. The bag is made to be used for storing solid, living tissue portions at cryogenic temperatures. The wide mouth of such a container may be heat sealed prior to storage. Such containers, while flexible and collapsible, exhibit effective strength and durability at such cryogenic temperatures.

14 Claims, 4 Drawing Figures

FIG. 1
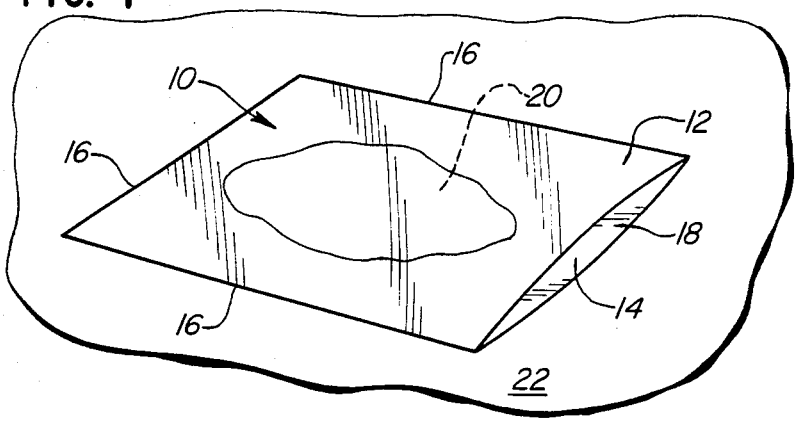
FIG. 2
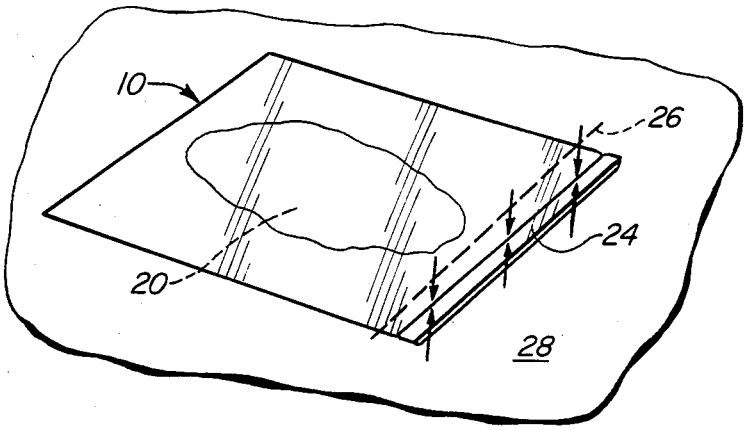
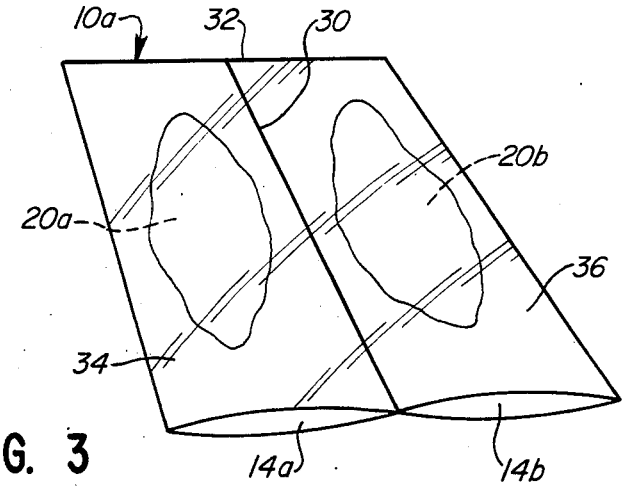
FIG. 3

CONTAINER FOR STORING SOLID LIVING TISSUE PORTIONS

TECHNICAL FIELD

Solid, living tissues are stored at cryogenic temperatures while awaiting use. Examples of such solid living tissues are skin used for skin grafts, cartilage, and duramater. The cryogenic temperature at which they are stored is most commonly from about −130° C. down to the boiling point of liquid nitrogen, which is −196° C.

At the present time individual clinics and hospitals tend to devise their own methods for tissue storage. For example, glass or plastic bottles or ampules are often used, which are subject to breakage, may be bulky, and which are sterilized with difficulty.

While it has been known to store solid tissue specimens in polyethylene, polyester, and other plastic pouches, problems may be encountered by the fact that many plastics are extremely brittle at temperatures below −150° C., so that if a plastic pouch has thin enough walls to be flexible and collapsible at room temperature, (which is most desirable for handling before and after loading the bag with a living tissue portion) the bag may shatter or crack upon encountering anything but the most delicate and gentle handling while at cryogenic temperatures.

Furthermore, it would be desirable for the solid tissue container to be hermetically sealable after the solid tissue is inserted in an aseptic manner so that there is no question of the maintenance of ascptic conditions.

By this invention, the above objectives are obtained to provide an effective, collapsible, wide-mouthed, sterile container which may be readily heat sealed to aseptically seal the contents of the container, and which is tough and durable for storing at cryogenic temperatures, with substantial space saving, when compared with glass bottles.

DESCRIPTION OF THE INVENTION

In accordance with this invention, solid, living tissue portions such as skin grafts or the like may be stored by placing a wide-mouthed, flexible, collapsible, sterile bag into an aseptic field containing said solid tissue portions. Typically, the aseptic field will be a surgical site or other tissue harvest site.

The bag of this invention may have been presterilized by, for example radiation sterilization or ethylene oxide gas sterilization. Naturally, sufficient time is provided for all ethylene oxide gas to have dissipated from the bag, so that the gas does not contact the solid tissue portions.

The bag of this invention may be made of sheeting of poly (ethylene-vinyl acetate) containing from 5 to 35 weight percent of vinyl acetate units. Preferably, the sheeting contains from about 10 to 30 weight percent of vinyl acetate units.

One then inserts the tissue portion into the bag through the wide mouth of the bag, which mouth may be substantially as wide as the bag itself. Following this, one may heat seal the wide mouth, making use of a bar-type impulse sealer of conventional design. The poly (ethylene-vinyl acetate) materials used in this invention are generally quite easily heat sealed.

Following this, the sealed bag is stored at a cryogenic temperature. For example, it may be immersed in liquid nitrogen to be stored at essentially −196° C., although other cryogenic temperatures, preferably no higher than about −130° C., may be used as well. Alternatively, the sealed bag may be more slowly cooled with controlled rate freezing.

As is well-known, living, solid tissue portions may be stored in this circumstance for a substantial period of time.

Following the storage period, when it is desired to retrieve the solid tissue portions from the container of this invention, the container or bag is preferably placed in a second aseptic field, for example a laminar flow hood or the like, and may be opened by severing the sheeting with a sicissors or knife to retrieve the tissue sample. The sample may then be conveyed to a surgical site under aseptic conditions and provided to the patient as a skin graft, or whatever use the solid tissue portion may have. Thus, the container of this application may provide significant advantages over prior art glass containers for solid, living tissue portions, as well as having significant advantages over other plastic containers which exhibit great brittleness to cryogenic temperatures, to provide an inexpensive, convenient, presterilized conta for solid tissue storage.

DESCRIPTION OF THE DRAWINGS

In the drawings, FIG. 1 is a perspective view of a wide-mouthed, flexible, collapsible, sterile bag in accordance with this invention, positioned in an aseptic field, with a skin graft shown inserted therein.

FIG. 2 is a perspective view of the bag of FIG. 1, in which the wide mouth is heat sealed to close it, to form an aseptic seal.

FIG. 3 is a perspective view of an alternative embodiment of the bag of this invention, which defines a pair of separate chambers communicating with said wide mouth.

DESCRIPTION OF SPECIFIC EMBODIMENTS

Figure 4:
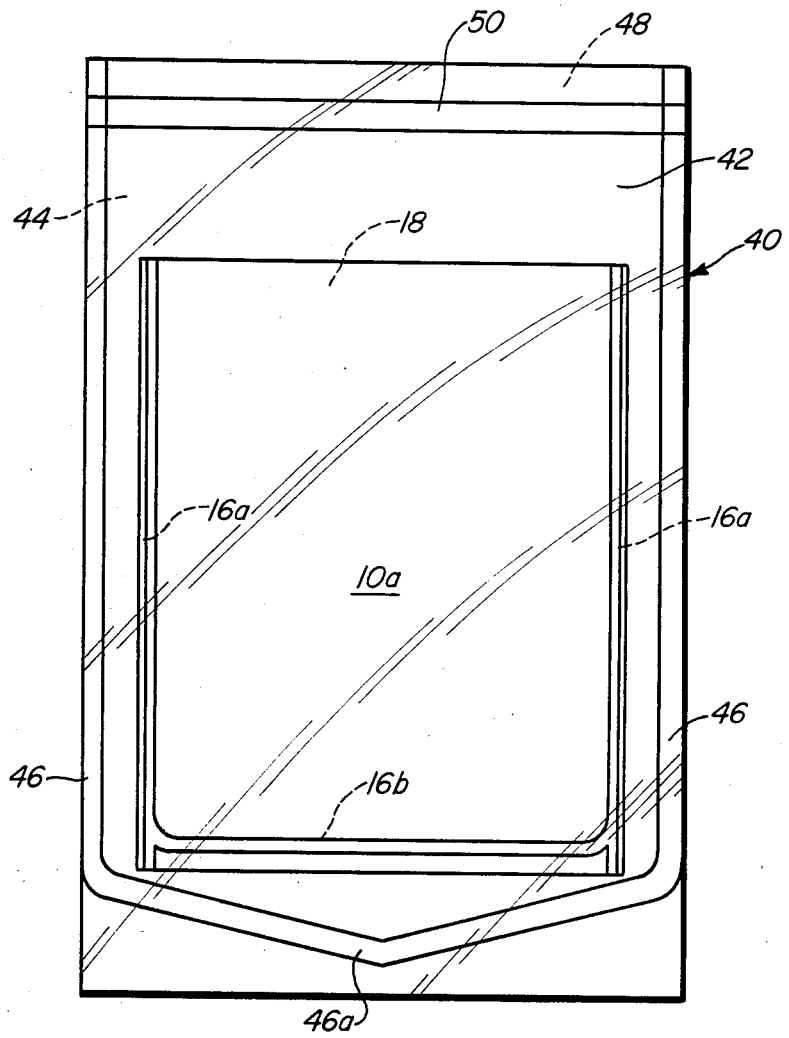
FIG. 4 is a plan view of at least one bag of this invention sealed in an overpouch.

Referring to FIGS. 1 and 2, plastic bag 10 is shown, being typically prepared from a pair of plastic sheets 12, 14, which are peripherally sealed together, such as by R. F. sealing, about three of their sides along heat sealed line 16. Bag 10 defines an open mouth 18 for receiving a solid living tissue portion, for example skin graft 20.

Bag 10 has been presterilized in a conventional manner, and rests in an aseptic field 22, for example a surgical field of the operation in which the skin graft is being harvested.

Each sheeting 12, 14 may be made of poly (ethylenevinyl acetate) in which the vinyl acetate content is 18 weight percent. Such material is commercially available. The wall thickness of the sheets 12, 14 is not deemed critical as long as the bag remains flexible and collapsible. Typically, a wall thickness of about 0.012 to 0.03 inch is contemplated, specifically about 0.015 inch.

Alternatively, bag 10 may be a flattened tube of poly (ethylene-vinyl acetate) sheeting, sealed closed at one end.

In FIG. 2, a subsequent step to the process is shown. After skin graft 20 has been placed in bag 10, a seal line 24 is formed adjacent mouth 14 of the bag to provide a hermetic sealing of skin graft 20 within bag 10. The sealing technique may be an impulse type heat seal formed with a sealing bar, to form fused seal line 24 between the two sheets 12, 14.

Following this, the sealed bag 10 containing skin graft 20 may be immersed in a liquid nitrogen storage unit, to provide storage of the skin graft for a period of days or longer.

When the skin graft is required for use, it is removed from the liquid nitrogen storage, and bag 10 may be cut open along a line indicated by dotted line 26, for example, with bag 10 being placed in a second sterile field 28, so that skin graft 20 may be conveyed from the harvesting site to its site of new installation under aseptic conditions.

As previously stated, the bag of this invention exhibits excellent physical properties at cryogenic temperatures, particularly those of liquid nitrogen, for improved strength while under cryogenic conditions. At the same time, the bag is easily sterilized by the manufacturer, and placed in an easy-to-open, typically gas-permeable package with a sterile interior, so that difficulties encountered by the use of glassware for storage of living tissue portions is eliminated.

Turning to FIG. 3, an alternative embodiment of the bag of this invention is shown as bag 10*a*. Bag 10*a* may be of a design similar to that of bag 10 except as otherwise described herein, being made of poly (ethylene-vinyl acetate) sheeting which is heat sealed together at the periphery and providing open mouths 14*a*, 14*b*.

At least one interior seal line 30 extends from mouths 14*a*, 14*b* to an opposed edge 32 of bag 10*a*, the seal line being formed during manufacture of bag 10*a* by a conventional R.F. impulse heat seal or the like. As a result of this, the pair of open mouths 14*a*, 14*b* are provided, each leading to separate, isolated, interior chambers 34, 36 of bag 10*a*. Accordingly, a bag of this design may be used to store two or more solid, living tissue portions 20*a*, 20*b*, being insertable into bag 10*a* through the wide mouths 14*a*, 14*b* thereof. Accordingly, tissue portions 20*a*, 20*b* in separate chambers are available for access without disturbing the contents of the adjacent chamber.

Bag 10*a* may be closed with a seal line analogous to line 24 in the previous embodiment, and stored in liquid nitrogen or other cryogenic conditions. When it is desired to retrieve one or more tissue portions 20*a*, 20*b*, one may open one or both the chambers 34, 36 by severingthe sheeting, to gain access under preferably aseptic conditions to either or both tissue portions.

Turning to FIG. 4, a bag 10*a*, of slightly differing design from that of FIGS. 1 through 3, is shown. In this particular embodiment the peripheral heat seal line 16*a* includes an end heat seal line 16*b* which is spaced from the end of bag 10*a*, which bag comprises a pair of peripherally sealed sheets of poly(ethylene-vinyl acetate) as in the previous embodiments.

The open mouth 18*a* is provided in container 10*a* as in the previous embodiments.

Preferably, a plurality of containers 10*a* are stacked for storage in a sealed overpouch 40, which comprises a clear plastic sheet 42 on one side and a sheet of gas permeable, bacteria blocking spun polyethylene 44 on the other side, for example, Tyvek® polyethylene, paper or the like.

A stack of plastic bags 10*a*, (for example, about eight of them), is inserted in overpouch 40 which carries peripheral heat seals 46, with the stack of bags 10*a* being inserted through mouth opening 48. Thereafter, transverse heat seal 50 closes mouth opening 48, and overpouch 40 is ETO sterilized. Accordingly, the stack of bags 10*a* may be stored under sterile conditions for an indefinite period of time, and then brought forth for use in the sterile field as previously described.

The chevron portion 46*a* of heat seals 46 facilitates tearing the package open for access to bags 10*a*, The above has been offered for illustrative purposes only, and is not intended to limit the scope of the invention of this application, which is as defined in the claims below.

That which is claimed:

1. The method of storing solid, living tissue portions, which comprises;

placing a wide-mouthed, flexible, collapsible, sterile bag into a aseptic field containing a solid tissue portion, said bag being made of sheeting of poly (ethylene-vinyl acetate) containing from 5 to 35 weight percent of vinyl acetate units;

inserting said tissue portion into said bag through the wide mouth;

heat sealing the wide mouth of said bag; and storing said bag at a cryogenic temperature;

and after said storage, placing said bag in a second, aspetic field and opening said bag by severing said sheeting to retrieve said tissue sample.

2. The method of claim 1 in which said cryogenic temperature is essentially −130° to −196° C.

3. The method of claim 1 in which said sheeting contains from 10 to 30 weight percent of vinyl acetate units.

4. The method of claim 1 in which said bag defines at least one interior seal line extending from the wide mouth to an opposed edge of the bag, to define at least a pair of separate chambers accessible through said wide mouth, in which a plurality of solid tissue portions are inserted through the wide mouth into said bag, whereby tissue portions in separate chambers are available for access without disturbing the contents of an adjacent chamber.

5. The method of claim 1 in which at least one of said bags is stored prior to insertion of said tissue portion in a gas permeable, bacteria blocking overpouch after gas sterilization

6. The method of storing sterile, living tissue portions, which comprises:

placing a wide-mounted, flexible collapsible, sterile beg into an aseptic field containing said solid tissue portion, said bag being made of sheeting of poly (ethylenevinyl acetate) containing from 10 to 30 weight percent of vinyl acetate units;

inserting said tissue portion into said bag through the wide mouth;

heat sealing the wide mouth of said bag;

storing said bag at a cryogenic temperature; and after said storage, placing said bag in a second, aseptic field and opening it by severing the sheeting to retrieve said tissue sample.

7. The method of claim 1 in which said cryogenic temperature is essentially −130° to −196° C.

8. The method of claim 6 in which said bag defines at least one interior seal line extending from the wide mouth to an opposed edge of the bag, to define at least a pair of separate chambers accessible through said wide mouth, in which a plurality of solid tissue portions are inserted through the wide mouth into said bag, whereby tissue portions in separate chambers are available for access without disturbing the contents of an adjacent chamber.

9. The method of claim 6 in which at least one of said bags are stored prior to insertion of said tissue portion in a gas permeable, bacteria-blocking overpouch after gas sterilization thereof.

10. The method of storing solid, living tissue portions, which comprises: placing a wide-mouthed, flexible, collapsible, sterile bag in a gas permeable, bacteria blocking overpouch after gas sterilization thereof, said bag geing made of poly (ethylene-vinyl acetate) containing from 5 to 35 weight percent of vinyl acetate units;

placing said sterile bag into an aseptic field containing a solid tissue portion;

inserting said tissue portion into said bag through the wide mouth;

heat sealing the wide mouth of said bag; and storing said bag at a cryogenic temperature.

11. The method of claim 10 in which, after storage, said bag is placed in a second, aseptic field and is opened by severing said sheet to retrieve said tissue sample.

12. The method of claim 10 in which said cryogenic temperature is essentially −130 degrees to −196 degrees.

13. The method of claim 11 in which said sheeting contains from 10 to 30 weight percent of vinyl acetate units.

14. The method of claim 11 in which said bag defines at least one interior seal line extending from the wide mouth to an opposed edge of the bag, to define at least a pair of separate chambers accessible through said wide mouth, in which a plurality of solid tissue potins are inserted through the wide mouth into said bag, whereby tissue portions in separate chambers are available for access without disturbing the contents of an adjacent chamber.

* * * * *